US009162288B2

(12) United States Patent
Akimoto et al.

(10) Patent No.: US 9,162,288 B2
(45) Date of Patent: Oct. 20, 2015

(54) METAL POWDER PRODUCTION METHOD, METAL POWDER PRODUCED THEREBY, CONDUCTIVE PASTE AND MULTILAYER CERAMIC ELECTRONIC COMPONENT

(75) Inventors: Yuji Akimoto, Fukuoka (JP); Kazuro Nagashima, Ohnojo (JP); Hidenori Ieda, Fukuoka (JP); Masayuki Maekawa, Fukuoka (JP)

(73) Assignee: SHOEI CHEMICAL INC., Shinjuku-ku, Tokyo (JP)

( * ) Notice: Subject to any disclaimer, the term of this patent is extended or adjusted under 35 U.S.C. 154(b) by 259 days.

(21) Appl. No.: 13/600,317

(22) Filed: Aug. 31, 2012

(65) Prior Publication Data

US 2013/0059161 A1 Mar. 7, 2013

(30) Foreign Application Priority Data

Sep. 2, 2011 (JP) ..... 2011-191198

(51) Int. Cl.

| | |
|---|---|
| ***B22F 9/30*** | (2006.01) |
| ***H01B 1/22*** | (2006.01) |
| *B22F 1/00* | (2006.01) |

(52) U.S. Cl.

CPC .. *B22F 9/30* (2013.01); *H01B 1/22* (2013.01); *B22F 1/0014* (2013.01); *B22F 2998/00* (2013.01)

(58) Field of Classification Search

None

See application file for complete search history.

(56) References Cited

U.S. PATENT DOCUMENTS

| | | | | |
|---|---|---|---|---|
| 3,062,638 | A * | 11/1962 | Culbertson et al. | 75/367 |
| 5,429,657 | A * | 7/1995 | Glicksman et al. | 75/351 |
| 5,976,217 | A | 11/1999 | Kneringer et al. | |
| 6,530,972 | B2 * | 3/2003 | Akimoto et al. | 75/351 |
| 7,066,980 | B2 * | 6/2006 | Akimoto et al. | 75/351 |
| 7,704,297 | B2 * | 4/2010 | Akimoto et al. | 75/348 |
| 2011/0293939 | A1 * | 12/2011 | Glicksman et al. | 428/402 |

FOREIGN PATENT DOCUMENTS

| | | | |
|---|---|---|---|
| CN | 1947902 | A | 4/2007 |
| CN | 101567264 | A | 10/2009 |
| CN | 101678461 | A | 3/2010 |
| EP | 1 398 101 | A2 | 3/2004 |
| EP | 1 972 397 | A2 | 9/2008 |
| JP | 2002-020809 | | 1/2002 |
| JP | 2004-099992 | | 4/2004 |
| JP | 2004-327715 | | 11/2004 |
| JP | 2005-154852 | | 6/2005 |
| WO | WO 2005/038086 | | 4/2005 |

OTHER PUBLICATIONS

EP Search Report dated Dec. 13, 2012 (5 pages).
Japanese Office Action dated Dec. 24, 2012 including English Concise Explanation of Relevance (4 pages).
Chinese Office Action for Appln. No. 201210461986.3 (7 pgs).
English Translation of Search Report in CN Appln. (1 pg).

* cited by examiner

*Primary Examiner* — George Wyszomierski
(74) *Attorney, Agent, or Firm* — Flynn, Thiel, Boutell & Tanis, P.C.

(57) ABSTRACT

Fine, highly-crystallized metal powder is produced at low cost and high efficiency by a method involving: ejecting raw material powder composed of one or more kinds of thermally decomposable metal compound powders into a reaction vessel through a nozzle together with a carrier gas and producing a metal powder by heating the raw material powder at a temperature $T_2$ which is higher than the decomposition temperature of the raw material powder and not lower than (Tm−200°) C. where Tm is the melting point (° C.) of the metal to be produced, while allowing the raw material powder to pass through the reaction vessel in a state where the raw material powder is dispersed in a gas phase at a concentration of 10 g/liter or less, wherein an ambient temperature $T_1$ of a nozzle opening part is set to a temperature of 400° C. or higher and lower than (Tm−200°) C.

5 Claims, No Drawings

METAL POWDER PRODUCTION METHOD, METAL POWDER PRODUCED THEREBY, CONDUCTIVE PASTE AND MULTILAYER CERAMIC ELECTRONIC COMPONENT

BACKGROUND OF THE INVENTION

1. Field of the Invention

The present invention relates to a method for producing a metal powder suitable for electronic applications, and more particularly, to a method for producing a metal powder with a fine, uniform particle size and a high degree of crystallinity which is useful as a conductive powder for use in a conductive paste, a metal powder produced by the method, a conductive paste, and a multilayer ceramic electronic component.

2. Description of the Related Art

In conductive metal powders used in conductive pastes that are used to form electronic circuits, it is desirable that these powders contain few impurities, that the powders be fine powders with a mean particle size as fine as 0.01 μm to 10 μm, that the particle size and particle shape be uniform, and that the powders have good dispersibility with no aggregation. Furthermore, it is also necessary that the dispersibility of the powder in the paste be good, and that the crystallinity be good so that there is no non-uniform sintering.

Especially in cases where such powders are used to form internal conductors or external conductors in multilayer ceramic electronic components such as multilayer capacitors, multilayer inductors and the like, in addition to being finer and having uniform particle size and shape in order to form the electrodes into a thin film, conductive metal powders are required to be resistant to the occurrence of expansion and shrinkage caused by oxidation and reduction during firing and have a high sintering starting temperature in order to prevent structural defects such as delamination or cracking. Consequently, there is a need for sub-micron sized metal powder having a spherical shape, low activity and high crystallinity.

Examples of conventional methods used to produce such a highly-crystallized metal powder include chemical vapor deposition (CVD), in which a vapor of a metal compound such as nickel chloride is reduced with a reducing gas at a high temperature, physical vapor deposition (PVD), in which a metal vapor is condensed in a gas phase, and spray pyrolysis, in which a solution or suspension of a metal compound dissolved or dispersed in water or an organic solvent is formed into fine liquid droplets, followed by carrying out pyrolysis by heating the droplets preferably at a temperature near or not lower than the melting point of the metal, whereby metal powder is produced.

In addition, methods for producing a highly-crystallized metal powder are also known in which pyrolysis is carried out at a high temperature using a solid powder for the raw material and in a state in which the solid powder is dispersed in a gas phase (see Japanese Patent Publication Nos. 2002-20809 and 2004-99992). In these methods, a highly-crystallized metal powder is obtained by supplying a raw material powder composed of a thermally decomposable metal compound powder to a reaction vessel using a carrier gas, and heating the material powder at a temperature higher than the decomposition temperature thereof and not lower than (Tm−200)° C. where Tm is the melting point (° C.) of the metal, in a state in which the material powder is dispersed in the gas phase at a concentration of 10 g/liter or less. Also, in these methods, a highly-crystallized metal powder is obtained by ejecting the raw material powder along with the carrier gas into the reaction vessel through a nozzle under the condition of V/S>600, with V representing the flow rate per unit time of the carrier gas (L/min), and S representing the cross-sectional area of the opening part of the nozzle ($cm^2$).

In the methods described in Japanese Patent Publication Nos. 2002-20809 and 2004-99992, since in comparison with spray pyrolysis there is no energy loss resulting from the evaporation of a solvent and the metal compound powder can be dispersed in a gas phase at a high concentration due to the use of a solid metal compound powder as the starting material, a spherical metal powder having a high crystallinity and superior oxidation resistance and dispersibility can be produced with a high efficiency. In addition, a metal powder of an arbitrary mean particle size and uniform particle size can be obtained by controlling the particle size and dispersion conditions of the raw material powder, and since an oxidative gas is not generated from a solvent, these methods are also suitable for producing easily oxidizable base metal powders required to be synthesized under a low oxygen partial pressure. Moreover, in comparison with vapor phase chemical reduction methods and the like, for which it is difficult to produce an alloy of metals having different vapor pressures in an accurately controlled composition, these methods also offer the advantage of being able to easily produce an alloy powder of an arbitrary composition by using a mixture or composite of two or more types of metal compounds.

In the case of the method described in Japanese Patent Publication No. 2004-99992 in particular, a solid raw material powder is ejected into a reaction vessel through a nozzle together with a carrier gas at a high linear velocity such that V/S >600, and, utilizing the rapid expansion of the gas in the reaction vessel, it is subjected to heat treatment at a high temperature and a low concentration in a gas phase and in a highly dispersed state so as not to cause mutual collisions between raw material particles and formed particles, thereby making it possible to easily produce a metal powder having an extremely narrow particle size distribution at a low cost and high efficiency.

There has recently been a strong demand for multilayer ceramic electronic components having a reduced size and increased layering, and in the area of multilayer ceramic capacitors using nickel for the internal electrodes in particular, both the ceramic layer and internal electrode layer are becoming increasingly thin. Consequently, an ultrafine nickel powder is required for use in the conductive paste for these internal electrodes that has, for example, an extremely small mean particle diameter of 0.3 um or less, a minimized inclusion of coarse particles and a narrower particle size distribution.

However, in the case of attempting to produce an even finer nickel powder than in the past using the methods described in Japanese Patent Publication Nos. 2002-20809 and 2004-99992, there are problems with respect to a tendency for the particle size distribution to increase along with poor production efficiency and yield.

These problems are presumed to be attributable to the following causes. Namely, in the methods described in Japanese Patent Publication Nos. 2002-20809 and 2004-99992, since nearly one metal particle or alloy particle is formed per particle of raw material, powder, the particle size of the metal powder is dependent on the particle size of the raw material powder. Thus, in order to obtain a finer metal powder, it is necessary to finely pulverize and disaggregate the raw material powder in advance. However, since the cohesive force of a powder increases as it becomes finer, it becomes difficult to disperse in which in addition to requiring an extremely long time for the disaggregation step, requiring a large amount of energy and contributing to poor production efficiency, large particles are formed easily due to re-aggregation. If such large, aggregated particles that are unable to be completely disaggregated are present in the raw material powder in this manner, the particle size and particle size distribution of the resulting metal particles increase. In addition, due to the inclusion of coarse metal particles, there are various detrimental effects on the characteristics of multilayer ceramic electronic components.

SUMMARY OF THE INVENTION

With the foregoing in view, an object of the present invention is to provide a method for producing a finer, highly-crystallized metal powder having a uniform particle size more stably and with good yield, and to provide a method that enables this metal powder to be produced in large amounts and at low cost, thereby solving the above-mentioned problems.

As a result of conducting further studies based on the methods described in Japanese Patent Publication Nos. 2002-20809 and 2004-99992, the inventors of the present invention focused on a phenomenon by which aggregated particles are able to break up on their own by gas generated when a raw material powder undergoes pyrolysis. The inventors of the present invention found that these aggregated particles can be made to break up efficiently by controlling the temperature to which the raw material powder is exposed immediately after being ejected from a nozzle to a specific range, thereby leading to completion of the present invention.

Namely, the gist of the present invention is a method for producing a highly-crystallized metal powder, the method comprising:

ejecting a raw material powder composed of one or more kinds of thermally decomposable metal compound powders into a reaction vessel through a nozzle together with a carrier gas under the condition of $V/S>600$, where V represents the flow rate per unit time of the carrier gas (liter/min) and S represents the cross-sectional area of the nozzle opening part ($cm^2$); and producing a metal powder by heating the raw material powder at a temperature $T_2$ which is higher than the decomposition temperature of the raw material powder and not lower than (Tm−200)° C. where Tm is the melting point (° C.) of the metal to be produced, while allowing the raw material powder to pass through the reaction vessel in a state where the raw material powder is dispersed in a gas phase at a concentration of 10 g/liter or less, wherein an ambient temperature $T_1$ of the nozzle opening part is set to a temperature of 400° C. or higher and lower than (Tm−200)° C.

The temperature $T_1$ is preferably set to be 500° C. or higher, and a raw material powder containing at least one kind selected from the group consisting of nickel compounds, copper compounds and silver compounds is preferably used as the raw material powder.

Furthermore, the present invention is directed to a highly-crystallized metal powder produced by the above-mentioned method, a conductive paste which contains the above-mentioned highly-crystallized metal powder, and a multilayer ceramic electronic component wherein conductor layers such as electrodes are formed using the above-mentioned conductive paste.

According to the method of the present invention, a fine, spherical, highly-crystallized metal powder which has a high purity, extremely narrow particle size distribution and high dispersibility can be easily produced at a low cost and high efficiency. In particular, the method of the present invention enables ultrafine nickel powder having an extremely narrow particle size distribution and free of coarse particles to be produced in a large amount and with good yield and is able to respond to needs for a reduced size and increased layering of multilayer ceramic electronic components.

In addition, since the metal powder obtained with the method of the present invention has a low activity and high oxidation resistance, in the case of using this metal powder in a conductive paste for forming electrodes of a multilayer ceramic electronic component, a highly reliable component free of cracks and other structural defects can be produced.

DESCRIPTION OF THE PREFERRED EMBODIMENTS

In the method of Japanese Patent Publication No. 2004-99992, the present invention is characterized by setting the ambient temperature $T_1$ of a nozzle opening part to a temperature of 400° C. or higher but lower than (Tm−200)° C., and heating by exposing a raw material powder to the temperature $T_1$ lower than the temperature $T_2$ immediately after ejecting the raw material powder from the nozzle, followed by heating at the temperature $T_2$ which is higher than the decomposition temperature of the raw material powder and not lower than (Tm−200)° C. Here, Tm represents the melting point (° C.) of the formed metal, and in the case of forming an alloy powder as the metal powder, refers to the melting point of the alloy. In addition, the ambient temperature of the nozzle opening part refers to an actual value of the ambient temperature surrounding the nozzle opening part as measured when raw material powder is ejected from the nozzle, and in actuality, is measured using a thermocouple at a location with a distance from the edge of the nozzle opening part being equal to about 6 times to 15 times the nozzle diameter. For example, in the examples to be subsequently described, the ambient temperature of the nozzle opening part was measured by inserting a thermocouple to a location 10 cm away from the edge of the nozzle opening part in a plane that includes the plane of the nozzle opening part.

More specifically, in a method as described in, for example, Japanese Patent Publication No. 2004-99992 in which, using a tubular reaction vessel heated from the outside with an electric furnace and the like, a raw material powder is ejected at a high rate into the reaction vessel through a nozzle together with a carrier gas so that the raw material powder undergoes pyrolysis in the reaction vessel in a highly dispersed state in a gas phase, and the metal powder formed is collected, the raw material powder is ejected to a region where the ambient temperature $T_1$ of the nozzle opening part is set to the above-mentioned temperature range.

In the case $T_1$ is lower than 400° C., the effects of the present invention are unable to be obtained. In addition, in the case $T_1$ is equal to or higher than (Tm−200)° C., it becomes difficult to obtain an extremely fine metal powder having a narrow particle size distribution. In addition, it is important in the present invention that the raw material powder immediately after being ejected be heated at a temperature of 400° C. or higher but lower than (Tm−200)° C., and the effects of the present invention cannot be obtained if a method is used in which the temperature of the raw material powder is raised to this temperature range after having been ejected at a temperature lower than 400° C., or the raw material powder is transported to a region heated to the above-mentioned temperature range after having been ejected at a high temperature of (Tm−200)° C. or higher.

The following is presumed on the basis thereof. In the method of the present invention, the raw material powder is exposed to a temperature of 400° C. or higher but lower than (Tm−200)° C. immediately after ejecting thereby causing the raw material powder to instantaneously undergo pyrolysis, and the gas resulting from pyrolysis of the raw material compound generated within the raw material powder at this time rapidly expands. Consequently, even in the case the raw material powder contains aggregated particles, the aggregated particles are explosively split open and disaggregated by the gas generated during pyrolysis. In addition, since the gas generated during pyrolysis envelops the particles formed by pyrolysis, re-aggregation is inhibited causing the particles to be further dispersed. Namely, even if aggregated particles are present in the raw material powder, the aggregated particles are broken up and dispersed simultaneous to pyrolysis, and this is thought to result in the formation of particles such as extremely fine oxides and other intermediate particles and metal particles. As a result of the formed particles subsequently being heated at the temperature $T_2$ while maintained in a highly dispersed state, reduction, solid-phase reactions, crystal growth inside the particles and the like occur, thereby resulting in the formation of an extremely fine, highly-crystallized metal powder having a uniform particle size. In the case $T_1$ is lower than 400° C., generation of gas is gradual due to gradual decomposition of the raw material powder, thereby causing the effect of disaggregation during pyrolysis to be inadequate and resulting in a broader particle size distribution and the presence of residual coarse particles. On the other hand, in the case $T_1$ is (Tm−200)° C. or higher, due to a sudden increase in the temperature of the raw material powder, sintering or crystallization progresses resulting in the formation of a hard shell on the particle surfaces prior to the particles being split open, and this prevents the particles from breaking up easily. Consequently, the particle size distribution of the formed powder increases and it becomes difficult to obtain fine particles. In addition, since the nozzle opening part reaches a high temperature, reactions proceed within the nozzle, thereby causing the nozzle to be blocked and making continuous operation difficult.

Furthermore, the decomposition temperature of thermally decomposable metal compounds is typically about 100° C. to 400° C., and in order to subject the raw material powder to pyrolysis immediately after ejecting, $T_1$ should theoretically be equal to or higher than the decomposition temperature. However, in the case of heating in a gas flow in a reaction vessel while allowing to pass therethrough, since the retention time in this region is short, it is actually necessary to set $T_1$ to a temperature higher than the decomposition temperature and at least 400° C. The optimum temperature range varies according to the type of metal and compound. For example, in the case of producing a nickel powder by using nickel acetate tetrahydrate powder, anhydrous nickel acetate powder or anhydrous nickel nitrate powder and the like having a decomposition temperature of about 350° C. as the raw material powder, $T_1$ is set to about 400° C. to 1250° C. and preferably 450° C. to 1200° C. In the case of producing a silver powder using, for example, silver (I) acetate powder (decomposition temperature: about 300° C.), $T_1$ is preferably set to 400° C. to 850° C., while in the case of producing a copper powder using, for example, basic copper (II) carbonate powder (decomposition temperature: about 300° C.), $T_1$ is preferably set to about 400° C. to 950° C. $T_1$ is preferably set to 500° C. or higher in order to ensure rapid decomposition of the raw material powder.

Examples of heating methods used to set $T_1$ to the above-mentioned temperature range include, for example, heating from outside the reaction vessel with an electric furnace or the like, heating with an electromagnetic furnace, heating by burning a flammable gas such as methane, ethane, propane, butane, ethylene or acetylene or a flammable liquid such as naphtha, kerosene, gas oil, gasoline or heavy oil in the reaction vessel, and supplying a gas preheated to a high temperature (to be referred to as a "secondary gas"), different from the carrier gas accompanying the ejected raw material powder (to be referred to as a "primary gas"), from outside the nozzle, and mixing the secondary gas with the mixture of the ejected raw material powder and carrier gas (primary gas) in the vicinity of the nozzle opening part. Heating may also be carried out by suitably combining these methods.

In the case $T_1$ is set to a comparatively low temperature of, for example, 800° C. or lower, from the viewpoint of thermal efficiency, instead of heating from the outside with an electric furnace, direct heating by other means is preferable, namely by a method such as heating by burning a flammable gas with a burner and the like, heating by burning a combustible liquid, or using a high-temperature secondary gas. Alternatively, these methods may also be used in combination with a method of heating from the outside with an electric furnace and the like.

Furthermore, in the case of heating with a high-temperature secondary gas as previously described, although a gas similar to the primary gas may be used for the secondary gas, high-temperature waste gas from a high-temperature furnace, turbine or boiler can also be used. However, since pyrolysis of the raw material powder occurs prior to the raw material powder becoming highly dispersed in the gas phase if the mixture of the raw material powder and carrier gas is heated to a high temperature prior to ejecting from the nozzle as previously described, in the case of using a high-temperature gas, it is supplied as a secondary gas from outside the nozzle.

In the case of heating by burning a flammable gas or flammable liquid as previously described as well, a pre-heated or unheated secondary gas may be supplied from outside the nozzle separate from the gas formed as a result of combustion.

In addition, in the case the metal is an easily oxidizable metal such as nickel or copper in particular, it is preferable that the metal compound be pyrolyzed to temporarily form an intermediate product such as an oxide which is then reduced to a metal at a high temperature, and in order to accomplish this, the atmosphere around the nozzle opening part is preferably made to be neutral or weakly oxidative. If pyrolysis occurs in a strong reducing atmosphere, coarse metal particles tend to be formed. In the case, for example, a nickel compound is reduced directly to nickel as a result of contacting a reducing gas, this is thought that the raw material powder is reduced from the outside while still aggregated prior to being split open and disaggregated by pyrolysis, and a metal shell is formed on the powder surface. As a result thereof, the raw material powder is inhibited from being disaggregated. Thus, in the case of heating by burning a flammable gas or flammable liquid in the reaction vessel, it is preferable that the location where the flammable gas or flammable liquid is burned be separated from the nozzle opening part so that the raw material powder is not ejected directly into the strongly reducing flame or the periphery thereof. However, the location where combustion takes place may be close to the nozzle opening part provided the flammable gas or flammable liquid is completely burned and is in a state that does not demonstrate reducing activity. Furthermore, in the case of supplying a high-temperature secondary gas as heating means as well, it is preferable not to use an excessively strong reducing gas. In order to maintain the atmosphere around the nozzle opening in a neutral to weakly oxidative state, it is effective to suitably blow an oxygen-containing gas or water vapor and the like into the reaction vessel.

The following provides a detailed description of conditions of the present invention other than those previously described.

Although there are no particular limitations on the metal powder produced with the present method, it is preferably used to produce a powder of a base metal such as copper, nickel, cobalt, iron, etc., or powder of a precious metal such as silver, palladium, gold, platinum, etc. The effects of the present invention can be enjoyed even more in the case of producing an extremely fine nickel powder having a mean particle size of, for example, 0.3 μm or less for use in a conductive paste for electrodes used in a multilayer ceramic electronic component in particular. In addition, a mixed powder of a plurality of metals or an alloy powder can be produced by combining raw material metal compound powders. In the present invention, a "metal powder" includes such mixed powders and alloy powders.

There are no particular limitations on the thermally decomposable metal compound serving as a raw material of the metal powder provided it generates a gas during pyrolysis, and examples of thermally decomposable metal compounds used include at least one compound of inorganic compounds such as hydroxides, nitrates, sulfates, carbonates, oxynitrates, oxysulfates, halides, oxides, ammonium complexes, etc.; or organic compounds such as carboxylates, resinates, sultanates, acetylacetone complexes, monohydric or polyhydric alcoholates of metal, amide compounds, imide compounds, urea compounds, etc. In particular, carbonates such as nickel carbonate, basic nickel carbonate, copper carbonate, basic copper carbonate, silver carbonate, etc.; oxalates such as nickel oxalate, copper oxalate, silver oxalate, etc.; carboxylates such as nickel acetate, nickel formate, nickel lactate, copper acetate, silver acetate, etc.; acetylacetone complexes such as nickel bis(acetylacetonate), copper bis(acetylacetonate), etc.; and other compounds such as resonates, alcoholates, etc. are preferable since they generate large amounts of gas during pyrolysis without forming harmful by-products following pyrolysis.

In cases where alloy powders or mixed powders are manufactured, raw material powders containing two or more metal components are used. In such cases, compound powders of the respective metal components may be uniformly mixed at a specified ratio and supplied; however, in order to obtain a powder comprising alloy particles in which the individual particles are uniform in terms of composition, it is desirable to use a composite powder which is composited beforehand so that a plurality of metal components are contained at a constant ratio in each particle of the raw material powder. Known methods such as a solid phase reaction method in which the metal compound powders used as the raw material are mixed beforehand, heat-treated until the composition is uniform, and then pulverized, as well as a sol-gel method, a co-precipitation method, a homogeneous precipitation method, a complex polymerization method and the like, can be used to obtain a composite powder. In addition, double salt powders, complex salt powders, polynuclear complex powders, complex alkoxide powders, metal double oxide powders and the like may also be used.

In order to more efficiently produce a fine metal powder having a narrow particle size distribution, it is preferable to adjust the particle size of the raw material powder in advance by pulverization, crushing or classification using a pulverizer or classifier. As the pulverizer, a jet-mill, a wet-type pulverizer, a dry-type pulverizer or the like can be used. Adjustment of the particle size may be performed prior to the dispersion of the raw material powder in the carrier gas; however, this adjustment may also be performed either after dispersing in the carrier gas or simultaneously with dispersing in the carrier gas by using a jet-mill or the like.

There are no particular limitations on the carrier gas (primary gas) accompanying the raw material powder in the case of a noble metal, and an oxidizing gas such as air, oxygen or water vapor, an inert gas such as nitrogen or argon, or a mixed gas thereof may be used. Although an inert gas is used preferably in the case of an easily oxidizable base metal such as nickel or copper, the atmosphere during high-temperature heating can be made to be weakly reductive to enhance anti-oxidative effects by mixing this with a reducing gas such as hydrogen, carbon monoxide, methane or ammonia gas, or organic compounds which decompose to form a reducing atmosphere when heated, such as alcohols, carboxylates and the like.

Preferably, the raw material powder is mixed and dispersed in the carrier gas using a dispersing device prior to ejecting the raw material powder into the reaction vessel through the nozzle. Known gas flow-type dispersing devices, such as an ejector-type device, a venturi-type device, an orifice-type device or the like or a known jet-mill can be used as the dispersing device.

In the method of the present invention, a solid raw material powder is ejected into a reaction vessel through a nozzle together with a carrier gas at a specified linear velocity, namely under the condition that $V/S>600$ when V represents the flow rate per unit time of the carrier gas (L/min) and S represents the cross-sectional area of the nozzle opening part ($cm^2$), and is highly dispersed at a concentration of 10 g/L or less in a gas phase. There are no particular restrictions on the nozzle. Nozzles of any shape, e.g., nozzles with a circular, polygonal or slit-like cross section, nozzles with a tip end of reduced cross section, nozzles with a reduced cross section at an intermediate point and a spreading opening part and the like may be used. In addition, although it becomes impossible to obtain a metal powder having a uniform particle size due to collisions among the powder and sintering if the concentration of the raw material powder in the gas phase is higher than 10 g/L, there are no particular limitations thereon provided the concentration is 10 g/L or less, and is suitably determined depending on the dispersing device and heating device used. However, since an excessively low concentration results in poor production efficiency, the concentration is preferably 0.01 g/L or more.

After having been ejected from the nozzle and pyrolyzed in the manner previously described, the raw material powder is heated at the temperature $T_2$ of higher than the decomposition temperature of the raw material powder and not lower than (Tm−200)° C. while maintained at the low concentration in a highly dispersed state. As a result, a highly-crystallized metal powder is formed. If $T_2$ is lower than the above prescribed temperature, a spherical, highly-crystallized metal powder is not obtained. In particular, in order to obtain a true-spherical, single-crystal metal powder having a smooth surface, heat treatment is preferably carried out at a temperature in the vicinity of the melting point of the target metal or at a temperature equal to or higher than that temperature. In addition, $T_2$ is preferably lower than the temperature at which vaporization of the formed metal powder becomes prominent, and is preferably (Tm+500)° C. or lower. Even if $T_2$ is higher than (Tm+500)° C., in addition to additional improvement effects not being obtained, the above-mentioned vaporization of the metal occurs easily.

Heating at $T_2$ is preferably carried out from outside the reaction vessel with an electric furnace and the like since this results in favorable efficiency as well as easier control of the atmosphere, gas flow and temperature. In order to carry out heat treatment while maintaining the dispersed state previously described, a tubular reaction vessel is used having a comparatively low temperature region, where the ambient temperature $T_1$ of the nozzle opening part is set to be within the aforementioned range, and a high-temperature region heated to the temperature $T_2$, and the raw material powder that is pyrolyzed as a result of being ejected into the low-temperature region through the nozzle is transported to the high-temperature region within the reaction vessel where a metal powder is formed, after which the metal powder is collected from the outlet of the reaction vessel. Although the raw material powder that has been pyrolyzed at temperature $T_1$ may be heated gradually by passing through the reaction vessel for which the temperature has been set such that the temperature rises in a stepwise manner from temperature $T_1$ to temperature $T_2$, the raw material powder may also be transported directly to the region heated to the temperature $T_2$. In addition, heating at temperature $T_1$ and heating at temperature $T_2$ can also be carried out in separate reaction vessels provided the condition of the raw material powder being in a dispersed state as previously described is maintained.

Although the retention time of the mixture of powder and carrier gas in the reaction vessel is set corresponding to the apparatus used so that the powder is adequately heated at the prescribed temperature, the retention time is normally about 0.3 seconds to 30 seconds. Since the raw material powder is heated at a low concentration in a gas phase while in a highly dispersed state produced by a high-speed gas flow in this manner, crystal growth proceeds in a short period of time by a solid phase reaction within the particles without causing aggregation of particles due to fusion or sintering even at high temperatures, and a metal powder having high crystallinity and few internal defects is presumed to be obtained.

Although the formed metal powder is cooled when it is collected, surface oxidizing treatment may also be carried out at this time by a method such as blowing in an oxidizing gas such as air. In addition, a metal powder having an even narrower particle size distribution can be obtained by classification on the formed metal powder as necessary.

EXAMPLES

The following provides a detailed explanation of the present invention using the examples and comparative examples described below. In the following descriptions, the term "mean particle size" refers to the mean value of particle size (μm) of 2000 independent particles randomly selected in an image of an arbitrary field of view observed with a scanning electron microscope (SEM). In addition, the terms "D10", "D50" and "D90" refer respectively to the values (particle diameters) in the weight-based cumulative fraction percentages 10%, 50% and 90% of distribution of particle diameters (μm) measured with a laser particle size distribution analyzer.

In addition, the ambient temperature $T_1$ of the nozzle opening part as measured by inserting a thermocouple (Sheath K, Okazaki Mfg. Company), in a reaction vessel, to a location about 10 an away from the edge of the nozzle in a plane that includes the plane of the nozzle opening face while the raw material powder is being ejected from the nozzle.

Reaction Apparatus

The reaction apparatus used in the examples and comparative examples (excluding Comparative Example 9) using a vertical tubular reaction vessel installed with a nozzle in the lower portion thereof for ejecting a raw material powder. A burner is installed below the nozzle opening part in the vessel, and the portion around the nozzle is heated by burning a mixture of town gas containing mainly methane and air with this burner. Furthermore, the burner is installed while allowing the installed location to move up and down or the orientation thereof to be changed to a degree that the flame did not make direct contact with the nozzle opening part, thereby enabling the ambient temperature of the nozzle opening part to be controlled. Moreover, an electric furnace is installed at a portion upward from a location roughly 1 cm below the nozzle opening part on the outside of the reaction vessel. This electric furnace employs a multistage configuration so that the temperature inside the reaction vessel increases in a stepwise manner moving upward in the reaction vessel from the nozzle ambient temperature $T_1$ to the temperature $T_2$.

In the present apparatus, a raw material powder is ejected at high speed into the reaction vessel from the above-mentioned nozzle together with a carrier gas, followed immediately thereafter by being exposed to the temperature $T_1$ set with the burner or by combining the use of the burner with the electric furnace at a location around the nozzle, and then being heated at the above-mentioned temperature $T_2$ by being transported to a region inside the reaction vessel heated to the temperature $T_2$. A cooling tube is installed at the upper outlet of the reaction vessel, and the formed metal powder is cooled by passing through the cooling tube after which it is collected with a bag filter.

In the following examples and comparative examples, the melting points of the metals are 1450° C. for nickel, 1083° C. for copper and 961° C. for silver.

Example 1

Nickel acetate tetrahydrate powder was pulverized with a jet mill to prepare a raw material powder having a D50 of about 0.8 μm. This powder was then ejected from a nozzle having an opening part cross-sectional area of 2 $cm^2$ at a supply rate of 30 kg/hr together with nitrogen gas at a flow rate of 2200 L/min into the reaction vessel of the above-mentioned reaction apparatus in which $T_1$ was set to 600° C. and $T_2$ was set to 1550° C. to produce a nickel powder. The concentration of the powder dispersed in the gas phase inside the reaction vessel was 0.23 g/L and V/S was 1100.

The resulting powder was analyzed with an X-ray diffractometer (XRD), transmission electron microscope (TEM), scanning electron microscope (SEM) and the like, and it was confirmed that this powder was substantially a single-crystal powder of metal nickel. SEM observation revealed that the particles of the powder had a true-spherical shape with a mean particle size of 0.19 μm, and there was hardly any aggregation observed between particles. In addition, the particle size distribution was measured and shown in Table 1. The value of (D90−D10)/D50 was 1.0, indicating that the powder has an extremely narrow particle size distribution.

Examples 2 and 3

Nickel powders were produced in the same manner as Example 1 with the exception of setting $T_1$ to 500° C. and 1200° C., respectively. The resulting powders in Examples 2 and 3 were composed of true-spherical particles which were substantially single-crystal particles and had mean particle sizes of 0.21 μm (Example 2) and 0.20 μm (Example 3), respectively, with little aggregation. The particle size distributions were as shown in Table 1, and the values of (D90−D10)/D50 were 1.1 and 1.0, respectively, thereby demonstrating narrow particle size distributions.

Comparative Example 1

A nickel powder was produced in the same manner as Example 1 with the exception of setting $T_1$ to 350° C. The resulting powder had a mean particle size of 0.26 μm, aggregation was observed, and as shown in Table 1, had a larger particle size and broader particle size distribution in comparison with Examples 1 to 3.

Comparative Example 2

A nickel powder was produced in the same manner as Example 1 with the exception of setting $T_1$ to 1300° C. The resulting powder had a mean particle size of 0.26 μm, aggregation was observed, and as shown in Table 1, had a larger particle size and broader particle size distribution in comparison with Examples 1 to 3. In addition, the nozzle became blocked roughly 5 hours after the start of ejecting, thereby preventing long-term continuous operation.

Example 4

A nickel powder was produced in the same manner as Example 1, except that the D50 of the raw material powder was about 0.6 μm. The resulting powder had a mean particle size of 0.18 μm, was composed of true-spherical particles which were substantially single-crystal particles, and it had no aggregation and, as shown in Table 1, demonstrated an extremely narrow particle size distribution.

Examples 5 to 7

Nickel carbonate powder was pulverized with a jet mill to prepare a raw material powder having a D50 of about 0.5 μm. This powder was ejected into the reaction vessel of a reaction apparatus at a supply rate of 30 kg/hr together with nitrogen gas at a flow rate of 2200 L/min so that $T_1$ and $T_2$ were at the temperatures shown in Table 2, after which carbon monoxide gas was introduced into the reaction vessel at a flow rate of 120 L/min at the portion of the reaction vessel where the temperature was 1350° C. to produce nickel powders. The concentrations of the powders dispersed in the gas phase inside the reaction vessel were 0.23 g/L and V/S values were 1100. The mean particle sizes of the resulting powders were 0.22 μm (Example 5), 0.24 μm (Example 6) and 0.23 μm (Example 7), and as shown in Table 1, the powders demonstrated narrow particle size distributions with little aggregation.

Comparative Examples 3 and 4

Nickel powders were produced in the same manner as Example 5 with the exception of setting $T_1$ to 350° C. and 1300° C., respectively. The mean particle sizes of the resulting powders were 0.27 μm in both cases, and as shown in Table 1, the particle size distributions thereof shifted towards coarse particles and were broader in comparison with Examples 5 to 7. In addition, the nozzle in Comparative Example 4 became blocked roughly 5 hours after the start of ejecting.

Example 8

Basic copper carbonate powder was pulverized with a jet mill to prepare a raw material powder having a D50 of about 1.0 μm. This powder was ejected into the reaction vessel of the above-mentioned reaction apparatus at a supply rate of 36 kg/hr together with nitrogen gas at a flow rate of 2200 L/min in which $T_1$ and $T_2$ had been set to the temperatures shown in Table 1 to obtain a copper powder. Furthermore, the dispersed concentration of the powder in the gas phase inside the reaction vessel was 0.27 g/L and V/S was 1100.

The resulting powder was analyzed by XRD, TEM and SEM as mentioned above, and it was confirmed that this powder was substantially a single-crystal metal copper powder. Observation by SEM revealed that the particles of the powder had a true-spherical shape with a mean particle size of 0.25 μm, and aggregation between particles was not observed. The particle size distribution of the powder is shown in Table 1.

Comparative Examples 5 and 6

Copper powders were produced in the same manner as Example 8 with the exception of setting $T_1$ to 300° C. and 1000° C., respectively. The resulting powders in Comparative Examples 5 and 6 had mean particle sizes of 0.33 μm and 0.32 respectively, and as shown in Table 1, the particle size distributions thereof shifted to coarse particles and were broader in comparison with Example 8. Furthermore, the nozzle in Comparative Example 6 became blocked roughly 7 hours after the start of ejecting.

Example 9

Silver acetate powder was pulverized with a jet mill to prepare a raw material powder having a D50 of about 2.5 μm. This powder was ejected into the reaction vessel of the reaction apparatus at a supply rate of 4 kg/hr together with air at a flow rate of 600 L/min in which $T_1$ and $T_2$ were set to the temperatures shown in Table 1 to produce a silver powder. The concentration of the powder dispersed in the gas phase inside the reaction vessel was 0.11 g/L and V/S was 750.

The resulting powder was analyzed by XRD, TEM and SEM, and it was confirmed that this powder was substantially a single-crystal powder of metal silver. Observation by SEM revealed that the particles had a true-spherical shape with a mean particle size of 0.59 μm, and aggregation between particles was not observed. The particle size distribution of the powder is shown in Table 1.

Comparative Examples 7 and 8

Silver powders were produced in the same manner as Example 9 with the exception of setting $T_1$ to 200° C. and 900° C., respectively. The mean particle sizes of the resulting powders in Comparative Examples 7 and 8 were 0.82 μm and 0.81 μm, respectively, and as shown in Table 1, their particle size distributions shifted towards coarse particles and were broader in comparison with Example 9. Furthermore, the nozzle in Comparative Example 8 became blocked roughly 4 hours after the start of ejecting.

Comparative Example 9

A nickel powder was produced under the same conditions as Example 1 with the exception of using a reaction apparatus of nearly the same size as that used in Example 1 except for not installing a burner, using a vertical tubular reaction vessel provided with a nozzle for ejecting raw material powder at the lower end of the reaction vessel and entirely and substantially uniformly heated with an electric furnace, and setting the heating temperature of the electric furnace to 1550° C. Although the resulting powder was substantially a single-crystal powder of metal nickel, aggregation was observed, the mean particle size was 0.29 μm, the particle size distribution was 0.27 μm (D10), 0.51 μm (D50) and 1.09 μm (D90), and the value of (D90−D10)/D50 was 1.6. In addition, the nozzle became blocked roughly 2 hours after the start of ejecting, thereby preventing long-term continuous operation.

TABLE 1

| | | Raw Material Powder | | | Formed Powder | | | | |
|---|---|---|---|---|---|---|---|---|---|
| | Raw Material | Particle Size (D50, μm) | $T_1$ (° C.) | $T_2$ (° C.) | Composition | D10 (μm) | D50 (μm) | D90 (μm) | (D90 − D10)/D50 |
| Ex. 1 | Nickel acetate | 0.8 | 600 | 1550 | Ni | 0.19 | 0.35 | 0.55 | 1.0 |
| Ex. 2 | Nickel acetate | 0.8 | 500 | 1550 | Ni | 0.21 | 0.36 | 0.60 | 1.1 |
| Ex. 3 | Nickel acetate | 0.8 | 1200 | 1550 | Ni | 0.21 | 0.36 | 0.57 | 1.0 |
| Comp. Ex. 1 | Nickel acetate | 0.8 | 350 | 1550 | Ni | 0.28 | 0.50 | 1.10 | 1.6 |
| Comp. Ex. 2 | Nickel acetate | 0.8 | 1300 | 1550 | Ni | 0.27 | 0.48 | 0.97 | 1.5 |
| Ex. 4 | Nickel acetate | 0.6 | 600 | 1550 | Ni | 0.20 | 0.30 | 0.50 | 1.0 |
| Ex. 5 | Nickel carbonate | 0.5 | 600 | 1550 | Ni | 0.20 | 0.38 | 0.62 | 1.1 |
| Ex. 6 | Nickel carbonate | 0.5 | 500 | 1550 | Ni | 0.21 | 0.41 | 0.67 | 1.1 |
| Ex. 7 | Nickel carbonate | 0.5 | 1200 | 1550 | Ni | 0.21 | 0.40 | 0.69 | 1.2 |
| Comp. Ex. 3 | Nickel carbonate | 0.5 | 350 | 1550 | Ni | 0.25 | 0.50 | 1.03 | 1.6 |
| Comp. Ex. 4 | Nickel carbonate | 0.5 | 1300 | 1550 | Ni | 0.24 | 0.49 | 1.00 | 1.6 |
| Ex. 8 | Basic copper carbonate | 1.0 | 500 | 1350 | Cu | 0.29 | 0.42 | 0.72 | 1.0 |
| Comp. Ex. 5 | Basic copper carbonate | 1.0 | 300 | 1350 | Cu | 0.33 | 0.58 | 1.20 | 1.5 |
| Comp. Ex. 6 | Basic copper carbonate | 1.0 | 1000 | 1350 | Cu | 0.30 | 0.54 | 1.08 | 1.4 |
| Ex. 9 | Silver acetate | 2.5 | 500 | 1300 | Ag | 0.37 | 0.62 | 1.02 | 1.0 |
| Comp. Ex. 7 | Silver acetate | 2.5 | 200 | 1300 | Ag | 0.52 | 1.09 | 2.18 | 1.5 |
| Comp. Ex. 8 | Silver acetate | 2.5 | 900 | 1300 | Ag | 0.51 | 1.05 | 2.01 | 1.4 |

What is claimed is:

1. A method for producing a crystallized metal powder, the method comprising:

ejecting a raw material powder composed of one or more kinds of thermally decomposable metal compound powders into a reaction vessel through a nozzle together with a carrier gas under the condition of V/S >600, where V represents a flow rate per unit time of the carrier gas (liter/min) and S represents a cross-sectional area of a nozzle opening part ($cm^2$); and producing a metal powder by heating the raw material powder at a temperature $T_2$ which is higher than a decomposition temperature of the raw material powder and not lower than (Tm−200°) C. where Tm is the melting point (° C.) of the metal to be produced, while allowing the raw material powder to pass through the reaction vessel in a state where the raw material powder is dispersed in a gas phase at a concentration of 10 g/liter or less, wherein an ambient temperature $T_1$ of the nozzle opening part is set to a temperature which is higher than the decomposition temperature of the raw material powder and is at least 400° C. and lower than (Tm−200°) C. and the raw material powder is exposed to the temperature $T_1$ immediately after being ejected into the reaction vessel wherein the temperature $T_1$ causes the raw material powder to undergo pyrolysis and generate a pyrolysis gas.

2. The method for producing a crystallized metal powder according to claim 1, in which the temperature $T_1$ is set to a temperature of 500° C. or higher.

3. The method for producing a crystallized metal powder according to claim 1, in which the raw material powder contains at least one compound selected from the group consisting of nickel compounds, copper compounds and silver compounds.

4. The method for producing a crystallized metal powder according to claim 1, wherein the raw material powder is selected from the group consisting of nickel acetate, nickel carbonate, copper carbonate and silver acetate.

5. The method for producing a crystallized metal powder according to claim 3, wherein the nickel compounds, copper compounds and silver compounds are selected from the group consisting of nickel, copper and silver hydroxides, nitrates, sulfates, carbonates, oxynitrates, oxysulfates, halides, oxides, ammonium complexes, carboxylates, resinates, sulfonates, acetylacetone complexes, monohydric or polyhydric alcoholates, amide compounds, imide compounds and urea compounds.

* * * * *